US005730645A

United States Patent [19]

Park

[11] Patent Number: 5,730,645

[45] Date of Patent: Mar. 24, 1998

[54] HARD COATED ABRASIVE MEDIUM WITH SELECTED DENSITY

[76] Inventor: Joon Park, 1320 Virginia Ave., Glendale, Calif. 91202

[21] Appl. No.: 723,312

[22] Filed: Sep. 30, 1996

Related U.S. Application Data

[60] Provisional application No. 60/023,478, Aug. 6, 1996 and provisional application No. 60/007,531, Nov. 24, 1995.

[51] Int. Cl.[6] ..... B24B 31/06

[52] U.S. Cl. ..... 451/32; 451/330; 451/326

[58] Field of Search ..... 451/32, 35, 326, 451/330

[56] References Cited

U.S. PATENT DOCUMENTS

| | | | |
|---|---|---|---|
| 1,133,368 | 3/1915 | De Vilbiss | 451/330 |
| 2,978,850 | 4/1961 | Gleszer | 451/330 |
| 5,140,783 | 8/1992 | Hoffman | 451/326 |
| 5,580,300 | 12/1996 | Tsutsumi | 451/35 |
| 5,601,475 | 2/1997 | Stametz et al. | 451/330 |

FOREIGN PATENT DOCUMENTS

| | | |
|---|---|---|
| 2403145 | 8/1974 | Germany . |
| 56-65500 | 11/1982 | Japan . |
| 1517093 | 7/1978 | United Kingdom . |

*Primary Examiner*—Eileen Morgan
*Attorney, Agent, or Firm*—Allen A. Dicke, Jr.

[57] ABSTRACT

The hard coated abrasive medium is formed by providing a hollow body with abrasive deposit on the outer surface. The buoyancy is provided by the enclosed space, and the weight is defined by the weight of the body plus the abrasive grit deposited thereon. The density is selected to be less than 1 so that the hard coated abrasive medium in a process which includes the abrasive medium plus water and plus the work-piece(s) upon which the abrasive medium is acting.

16 Claims, 1 Drawing Sheet

HARD COATED ABRASIVE MEDIUM WITH SELECTED DENSITY

CROSS-REFERENCE

This application relies upon provisional application Ser. No. 60/007,531, dated Nov. 24, 1995, and on provisional application, Ser. No. 60/023,478, filed Aug. 6, 1996.

FIELD OF THE INVENTION

This invention is directed to an abrasive medium which can be manufactured with a density lower than 1 or manufactured with a density greater than 1, and is particularly useful in wood processes where the abrasive can be floated away from the workpieces.

BACKGROUND OF THE INVENTION

There has arisen in recent years processes for imparting a soft, worn look to new clothing, in particular denim jeans. This is related to the laundering industry and is a wet process known as "stone washing". Consumers will pay a significant premium for clothes have a soft, worn look, and a number of methods have been developed for washing new garments and fabrics to cause them to have the desired feel and appearance. Among the methods presently employed for stone washing include washing with large pumice stones, usually ½ to 4 inches in diameter. These large stones circulate in a washing machine during the wash cycle and cause the garments to abrade and soften. It can be appreciated that this sometimes creates damage to the garments and makes them unsuitable for sale. Volcanic rock is usually more glassy then pumice and is sometimes used in a similar way. U.S. Pat. Nos. 4,575,887 and 4,750,227 represent this type of wet process. Manufactured substitutes for the natural pumice and volcanic rock have been tried. U.S. Pat. No. 5,359,745 formed into a briquette together with calcium carbonate which is then fired to produce a foam-to-glass briquette which substitutes for the pumice stone. Synthetic polymer composition material has also been taught to be useful in creating a briquette. In this case, polyvinyl chloride is filled with abrasive aluminum trihydrate to provide a resilient, yet abrasive pellet. This structure is thought to be less likely to pound holes into the garment. Similarly, U.S. Pat. No. 5,093,948 teaches the use of an elastomer rubber ball made of polybutadiene without any abrasive.

Many different materials and shapes have been used as the abrasive medium in stone washing of garments to achieve alterations in the surface and texture of the garment. There are many different abrasive mediums that are commonly used in various processes, including wood, walnut shells, sawdust, granite, various metals, limestone, ceramic beads, dry ice, nylon, rubber and synthetic rubberized abrasive. These abrasive mediums are used in tumblers or barrels, wet or dry, depending upon the process involved. It is believed that all abrasive medium is a consumable product because the surface of the medium changes its characteristics with wear, and the medium itself wears out through the abrading action on the workpieces. This limits the usage of many common mediums which are used in food product applications, such as skin-peeling processes for potatoes, nuts or carrots.

There is need for an abrasive medium which is of long wear life and which is of controllable density so as to properly interact with the workpiece.

SUMMARY OF THE INVENTION

In order to aid in the understanding of this invention, it can be stated in essentially summary form that it is directed to an abrasive medium with selected density. In this case, the body of the medium is made up of a pair of cups which face each other and which are sealed together to enclose the hollow interior space. The cups are usually metallic, and the abrasive medium is coated thereon by plasma coating or by inclusion in a softer matrix.

It is, thus, a purpose and advantage of this invention to provide an abrasive medium which can be manufactured with a selected density so as to be proper density with respect to the material it is to abrade.

It is a further purpose and advantage of this invention to provide an abrasive medium with a density of less than 1 particularly useful in the stone washing of garments in a wet process or by the abrasive medium floats on the surface.

It is a further purpose and advantage of this invention to provide a process for stone washing garments which includes the use of a manufactured abrasive medium with density less than 1 so that the medium floats on the water in the wet process and the abrasive medium is withdrawn from the processing drum before the garments are separated from the water.

Other purposes and advantages of this invention will become apparent from a study of the following portion of the specification, the claims-and the attached drawings.

DESCRIPTION OF THE PREFERRED EMBODIMENTS

Figure 1:
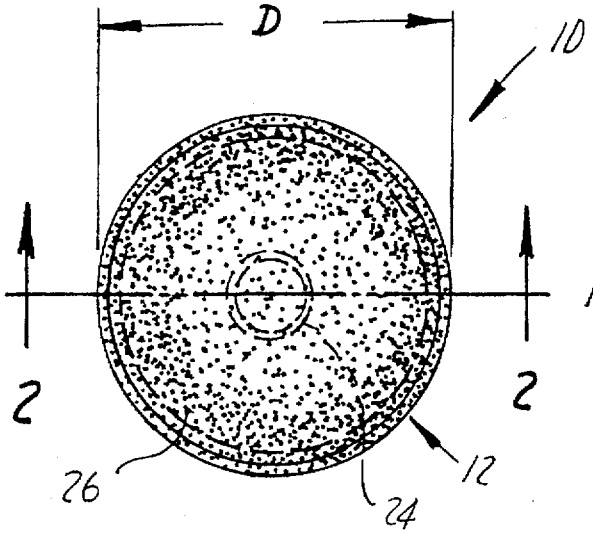
FIG. 1 is a plan view of the first preferred embodiment of the abrasive medium with selected density in accordance with this,invention.
Figure 2:
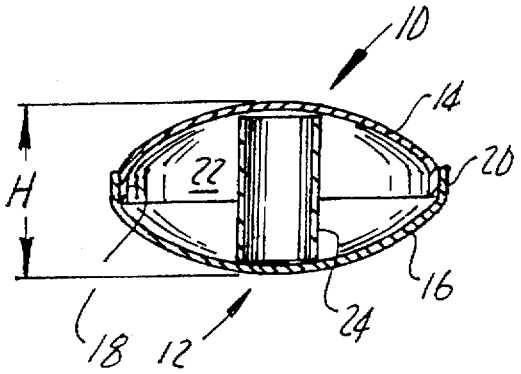
FIG. 2 is a section taken generally along the line 2—2 of FIG. 1.

The first preferred embodiment of the abrasive medium of this invention is generally indicated at 10 in FIGS. 1 and 2. The abrasive medium 10 has a body 12 which is formed of first and second cups 14 and 16. As is seen in FIG. 2, the rim 18 of first cup 14 fits within the rim 20 of second cup 16. The fit is preferably a press-fit and, in final assembly, the rims are sealed together by any convenient means such as adhesive, reflow soldering, welding or the like. The exterior of the body 12 thus defines the volume of the abrasive member, and the interior space 22 defines its buoyancy. The weight is defined by the thickness of the material of the cups and by the abrasive applied. Thus, for the very lightest density, the thickness of the cup should be minimal. With minimal thickness, an interior support may be necessary to support the domes of the cups. Thus, support 24 is shown. The support 24 is tubular material and is installed before the cups are closed one on the other. The material of the cups is preferably sheet stainless steel.

Abrasive grit 26 is metallurgically bonded to the outer surface of the cups. The abrasive can be any hard material, such as diamond, silicon carbide, boron carbide, tungsten carbide, cubic boron nitride or hard plating. It can be deposited on the surface by any convenient deposition means, such as flame spraying, plasma arc spraying or deposition of the abrasive material in a softer matrix.

There are several ways to select the density of the abrasive medium 10. As a particular example, when the diameter D is 38 millimeter and the height H is 16 millimeter, it can be made out of 0.30 millimeter thick stainless steel. When assembled with a 0.038 millimeter thick tungsten carbide coating, the net density is 0.93 gram per cubic centimeter. Thus, the density for a cap-shaped structure which can be conveniently manufactured can range upward from 0.30. An increase of interior volume and decrease in the amount of material in the cups and coating can decrease the density down to 0.30 and still provide an abrasive medium with reasonable life. The density of the abrasive medium should be less than the density of the workpieces with which it is used.

Figure 3:
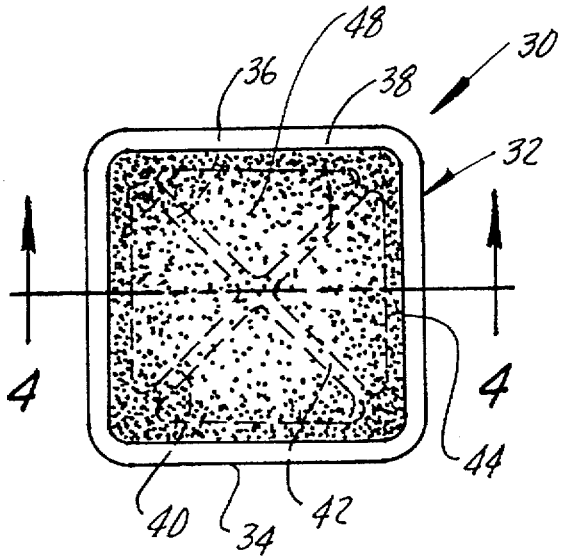
FIG. 3 is a plan view of a second preferred embodiment of an abrasive medium with selected density in accordance with this invention.
Figure 4:
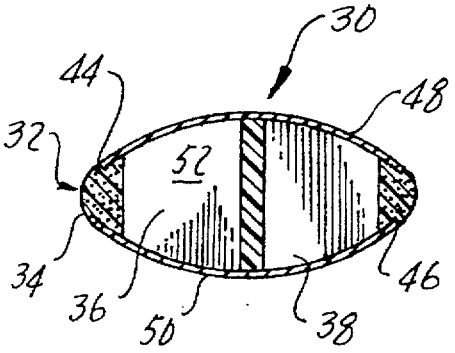
FIG. 4 is a view taken along the line 4—4 of FIG.

The abrasive medium 30, shown in FIGS. 3 and 4, is a second preferred embodiment of manufacturing an abrasive medium with selected density. In this case, a synthetic polymer composition material frame 32 is molded. Since the medium 30 is expected to be subjected to high temperatures, a thermosetting material is preferred. In quantity, the frame can be injection-molded. The frame is comprised of a rim 34 which is generally square in plan view, as seen in FIG. 3, with rounded corners. The rim may be joined with center support ribs 36, 38, 40 and 42. The support ribs are cross-shaped, as seen in FIG. 3, and are directed to the corners of the frame. The rim of the frame is a top shoulder 44 and a bottom shoulder 46, which define a recess all the way around the rim into which the top and bottom cups 48 and 50 rest. The top and bottom cups are concave cups of generally spherical section and are preferably stamped of a rust-resisting material such as stainless steel. They are configured to fit over the spherical top and bottom curves of the center support and engage in the top and bottom shoulders 44 and 46. A fairly tight fit is desirable. The cups 48 and 50 are adhesively attached to the tops and bottom of the center support ribs and are sealed around the shoulders to define an interior volume 52. There is one interior volume, even those divided into four sections by means of the center support ribs. The center support ribs may have openings therethrough to equalize air pressure therebetween.

The top and bottom cups 48 and 50 are first coated with abrasive grit. The cups are then assembled onto the frame 32. The same kind of abrasive grit is used as on abrasive medium 10 and is applied in the same way. The density of the abrasive medium 30 is adjusted by controlling the weight with respect to the volume. Round- and square-shaped abrasive medium 10 and 30 are disclosed. However, it is clear that any structure with a round cross-section can be built in the manner illustrated in FIGS. 1 and 2. The cups can be of shapes other than the smooth spherical domes illustrated. Furthermore, the abrasive medium 30 is built on a frame to illustrate them manufactured by generally square abrasive medium. However, the abrasive medium can be made in any practical shape, such as a wedge, triangle, arrowhead, tristar, cone, pyramid, cylindrical wedge, tetrahedron, ellipse, angle-cut cylinder and the like. Each piece of the abrasive medium 30 can have the same range of size and range of density as each piece of the abrasive medium 10.

A particular process in which the utilization of an abrasive medium with a density below 1.0 is in the abrasive wear of garments in commercial laundering machines for the purpose of imparting the appearance of wear and softening the fabric. In accordance with this process, the garments to be softened are placed in a commercial washing machine together with sufficient water and washing materials. These washing materials may include a desizing agent, a detergent and/or an emulsifier. In addition, the abrasive medium in accordance with this invention is placed therein in sufficient quantity. As an example of the manner in which it is expected to work, 100 pounds of denim garments are introduced into a commercial washing machine together with about 4000 of the abrasive medium in accordance with this invention, sufficient water and 3 pounds of desizing agent together with 3 pounds of a detergent-emulsifier. The machine is then agitated for 15 to 60 minutes until the garments are processed to the extent desired. At the end of agitation, the abrasive mediums float and are withdrawn from the top of the water. Another short cycle of agitation may be employed if it is necessary to release pieces of abrasive medium which are caught in the garments. After the abrasive medium is withdrawn from the surface, then the water and garments are separated. As is usual, further processing such as bleaching, neutralizing and rinsing may be employed, as required.

This invention has been described in its presently contemplated best embodiment, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An abrasive medium comprising:

a body, said body being formed with an external surface, said body being made of metallic material, said body being formed of at least one convex cup and a cover secured thereto hollow to define an interior sealed hollow space; and abrasive grit bonded to the exterior surface of said body so that a plurality of said medium may be tumbled with workpieces to be abraded.

2. The abrasive medium of claim 1 wherein said abrasive grit is selected from the group consisting of diamond, silicon carbide, boron carbide, tungsten carbide, cubic boron nitride deposited on the outer surface of said body.

3. The abrasive medium of claim 1 wherein said metallic material is stainless steel.

4. The abrasive medium of claim 1 wherein said rims are attached to each other to define said hollow interior space, said cups being sized so that the density of said abrasive medium is less than 5.

5. The abrasive medium of claim 4 wherein said metallic material is stainless steel.

6. The abrasive medium of claim 5 wherein said abrasive grit is selected from the group consisting of diamond, silicon carbide, boron carbide, tungsten carbide, cubic boron nitride deposited on the outer surface of said body.

7. An abrasive medium comprising:

a body, said body being formed of a frame and first and second cups, said cups being engaged against said frame and said cups being sealed with respect to said frame to define a hollow interior between said cups; and abrasive grit attached to the external surface of said cups so that a plurality of said medium may be tumbled with workpieces to be abraded.

8. The abrasive medium of claim 7 wherein said abrasive grit is selected from the group consisting of diamond, silicon carbide, boron carbide, tungsten carbide, cubic boron nitride deposited on the outer surface of said body.

9. The abrasive medium of claim 8 wherein said metallic material is stainless steel.

10. An abrasive medium comprising:

a metallic body, said body having an exterior surface, said body being made of a convex metallic cup and a cover therefor secured together to define a hollow interior space; and abrasive grit metallurgically bonded to the exterior surface of said body so that said abrasive medium can be shaped and sized to have a density of less than 1 so that it is buoyant in water.

11. The abrasive medium of claim 10 wherein said abrasive grit is selected from the group consisting of diamond, silicon carbide, boron carbide, tungsten carbide, cubic boron nitride deposited on the outer surface of said body.

12. The abrasive medium of claim 10 wherein said metallic body is made of stainless steel.

13. The abrasive medium of claim 10 wherein said convex cups have rims and said rims are positioned to engage with respect to each other, said rims being sealed with each other to enclose the space within said medium.

14. An abrasive medium comprising:

a metallic body, said body having an exterior surface, said body being made of at least one convex metallic cup and a cover therefor secured together, said metallic cup and cover having edges, a frame, said frame having shoulders thereon to receive the edges of said metallic cup and cover to seal with respect to said cup and cover so as to define a sealed hollow interior space within said abrasive medium; and hard plating plated to the exterior surface of said body so that said cups, said frame, said hard plating and said interior space are shaped and sized to have a density less than about 1.

15. The process of abrading workpieces comprising:

depositing workpieces and water into an abrading machine with sufficient water so that said combined workpieces and water are fluid within the abrading machine;

depositing within the abrading machine a plurality of abrasive medium which are formed as hollow metallic bodies each formed of at least one convex cup and a cover secured thereto to define a hollow interior space and an exterior surface with abrasive grit thereon, with the abrasive medium having a density less than 1 so that it floats in water;

agitating the workpieces and abrasive medium so that the abrasive medium treats the workpieces to the desired extent;

removing the abrasive medium floating on the surface of the water; and subsequently separating the workpieces and the water.

16. The method of claim 15 further including a penultimate step of further agitating the workpieces and water to release any trapped abrasive medium to rise to the surface and removing floating abrasive medium from the abrading machine.

* * * * *